US007558399B2

(12) United States Patent
Akino

(10) Patent No.: US 7,558,399 B2
(45) Date of Patent: Jul. 7, 2009

(54) VIBRATING PLATE OF DYNAMIC MICROPHONE AND METHOD OF MANUFACTURING THE SAME

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 500 days.

(21) Appl. No.: 10/993,060

(22) Filed: Nov. 19, 2004

(65) Prior Publication Data

US 2005/0135652 A1 Jun. 23, 2005

(30) Foreign Application Priority Data

Dec. 18, 2003 (JP) ..... 2003-420745

(51) Int. Cl.
*H04R 31/00* (2006.01)
*H04R 9/08* (2006.01)
*H04R 9/00* (2006.01)

(52) U.S. Cl. ..... 381/426; 381/189; 381/398; 381/423; 381/430; 29/594; 181/164; 181/167; 181/171; 181/172

(58) Field of Classification Search ..... 381/423, 381/424, 426, 430, 170, 177, 398, 407, 369; 181/167–170, 173, 171, 164, 166; 29/594, 29/609.1

See application file for complete search history.

(56) References Cited

U.S. PATENT DOCUMENTS 3,616,529 A * 11/1971 Iding ..... 29/594
4,410,768 A * 10/1983 Nakamura et al. ..... 381/423
6,378,649 B1 * 4/2002 Inoue et al. ..... 181/167
7,460,679 B2 * 12/2008 Itoh et al. ..... 381/184
2004/0042632 A1 * 3/2004 Hutt et al. ..... 381/423
2004/0238267 A1 * 12/2004 Sakamoto et al. ..... 181/157

FOREIGN PATENT DOCUMENTS

JP 59061295 A * 4/1984
JP 05260592 * 3/1992
JP 04-115696 4/1992

* cited by examiner

*Primary Examiner*—Wayne R Young
*Assistant Examiner*—Dionne H Pendleton
(74) *Attorney, Agent, or Firm*—Husch Blackwell Sanders LLP Welsh & Katz

(57) ABSTRACT

It is an object of the present invention to provide a vibrating plate of a dynamic microphone and a method of manufacturing the vibrating plate. The vibrating plate includes a center dome and a sub-dome which includes a damping thin film having stable quality.

Referring to FIG. 1*d*, the method of manufacturing the vibrating plate 1 includes the step of temporally fixing the vibrating plate 1 having the center dome 10 and the sub-dome 20 on a rotating pedestal 40, and the step of applying an ultraviolet curing-resin without volatile components 50 to form a continuous streak-pattern on the whole inner circumference of the sub-dome 20 with the resin, and the step of conforming the ultraviolet curing-resin 50 to the dome surface of the sub-dome 20 with the resin 50 spontaneously falling along the curved surface of the sub-dome 20 without centrifugal force, and the step of forming the resin 50 to the thin film with the resin spreading as far as the outer circumference 20*b* of the sub-dome 20 by centrifugal force, and the step of hardening the resin 50 by emitting ultraviolet rays to form the damping thin film 50*a*.

2 Claims, 3 Drawing Sheets

VIBRATING PLATE OF DYNAMIC MICROPHONE AND METHOD OF MANUFACTURING THE SAME

FIELD OF THE INVENTION

The present invention relates to a vibrating plate of a dynamic microphone and a method of manufacturing the vibrating plate. More particularly, the invention relates to the art of mechanically damping a sub-dome of the vibrating plate.

BACKGROUND OF THE INVENTION

As shown in FIG. 3, a dynamic microphone generally uses a vibrating plate formed with synthetic resin such as polyethylene or polyester. The vibrating plate includes a center dome and a sub-dome which elastically supports the center dome and which connects and communicates with the outer circumference of the center dome.

A voice coil 30 for generating electricity is installed in the center dome 10 with an adhesive or the like. The voice coil 30 is disposed in a magnetic gap (not shown) and the coil as well as the center dome 10 is vibrated by arriving sound waves in the magnetic gap so that the sound waves are converted to an electric signal.

When a dynamic microphone is an unidirectional dynamic microphone, the control system of the unidirectional dynamic microphone is mass control system so that sounds in low frequencies can be captured by lowering a resonance frequency of a low frequency range. As described in Japanese Patent Application Publication No. 4-115696, in order to lower a resonance frequency of the vibrating plate, the voice coil 30 is added in weight or the spring force of the sub-dome 20 is weakened (the stiffness of the sub-dome is decreased).

However, the addition in weight of the voice coil 30 increases handling noises so that the way of adding in weight of the coil is unacceptable regarding to a handheld microphone. On the other hand, in order to decrease the stiffness of the sub-dome 20, there are generally two ways of which one is to thin the thickness of the sub-dome 20 and of which the other is to increase the curvature radius of the sub-dome 20. The both ways decrease a mechanical strength of the sub-dome so that an abnormal resonance is generated in a moderate high frequency range of 2 kHz to 8 kHz of the frequency response as shown in FIG. 4. Therefore, neither way is preferable.

The way prior art limits an occurrence of the abnormal resonance will be described hereinafter. A peripheral treatment agent is applied on the substantial whole of the back side of the sub-dome 20 (the concave surface side of the sub-dome in FIG. 3) and a mechanical damping thin film is formed so that the abnormal resonance in the moderate high frequency range can be prevented.

Coated type resin is used as the peripheral treatment agent above-described. The peripheral treatment agent is diluted with an organic solvent such as toluene in order to simplify the applying operation. However, practically, the coated type resin can not be equally diluted lot-by-lot so that each lot of the resin is different in the quality of each of the damping thin films and the effect of preventing the abnormal resonance is not equal.

Further, the damping thin film is hardened by volatilizing the organic solvent and a curing time of each thin film is different due to the factors of the ambient environment so that the quality of the damping thin film is unstable.

SUMMARY OF THE INVENTION

It is an object of the present invention is to provide a vibrating plate of a dynamic microphone, the vibrating plate having a center dome and a sub-dome which includes a damping thin film having stable quality in order to effectively suppress an abnormal resonance in a moderate high frequency range.

It is another object to provide a method of manufacturing the vibrating plate.

In order to carry out the object, as a first aspect of the invention, the vibrating plate of the dynamic microphone has the center dome in which an electricity generating voice coil is mounted and the sub-dome which connects and communicates with the outer circumference of the center dome. The vibrating plate is characterized in that the damping thin film formed with an ultraviolet curing-resin is formed on substantially the whole area of the back side of the sub-dome and is integrated with the sub-dome.

In the first aspect described above, it is preferable that the damping thin film 50*a* has a thickness of 10 μm to 0.5 mm and a hardness of Shore D-scale 15±10 (especially, 15±5) in order to suppress the abnormal resonance in the moderate high frequency range of 2 kHz to 8 kHz of the frequency response.

In order to achieve another object, as a second aspect of the invention, in the manufacturing method of the vibrating plate of the dynamic microphone, the vibrating plate has the center dome in which an electricity generating voice coil is mounted and the sub-dome which connects and communicates with the outer circumference of the center dome. It is characterized in that the method includes a first step of temporarily fixing the vibrating plate on the rotating pedestal by predetermined fixing means with the back side of the vibrating plate facing up, and a second step of applying an ultraviolet curing-resin without volatile components to form a continuous streak-pattern on the whole inner circumference of the sub-dome with the resin. It is characterized in that the method further includes a third step of conforming the ultraviolet curing-resin to the dome surface of the sub-dome with the resin spontaneously falling along the curved surface of the sub-dome by gravity without the action of centrifugal force, and a fourth step of forming the ultraviolet curing-resin to a thin film by rotating the vibrating plate as well as the rotating pedestal with the resin spreading as far as the outer circumference of the sub-dome by centrifugal force, and the fifth step of hardening the ultraviolet curing-resin formed to the thin film by emitting ultraviolet rays.

In the second aspect described above, in order to form the uniform thin film, it is preferable that the rotation speed of the vibrating plate is 10 rpm to 500 rpm in the fourth step and in the fifth step the ultraviolet rays are emitted while the vibrating plate is rotated.

According to this invention, since the ultraviolet curing-resin without volatile components is used as the peripheral treatment agent forming the damping thin film to the sub-dome, the damping thin film which has stable quality is shortly formed with no influence of an ambient environment such as temperature or humidity. Whereby, the vibrating plate of the dynamic microphone which can capture sounds of low frequencies is provided. The vibrating plate generates no abnormal resonance in the moderate high frequency range of 2 kHz to 8 kHz of the frequency response.

DETAILED DESCRIPTION OF THE PREFERRED EMBODIMENTS

Figure 1A:
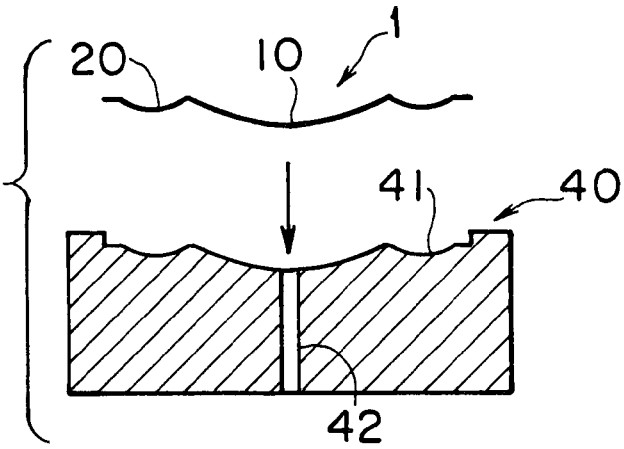
FIGS. 1*a*, 1*b*, 1*c* and 1*d* are views to explaining the steps of manufacturing a vibrating plate embodying the present invention.
Figure 1B:
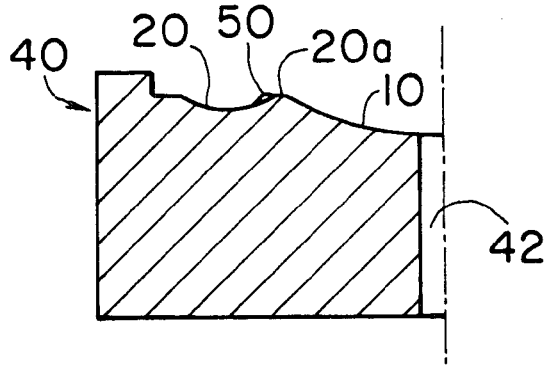
Figure 1C:
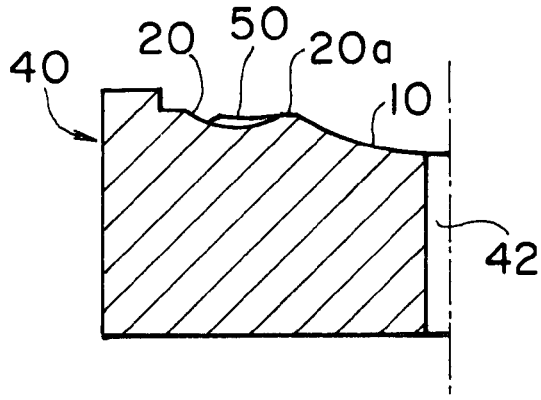
Figure 1D:
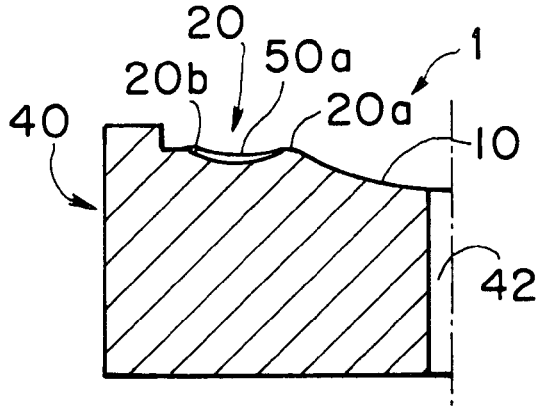
Figure 2:
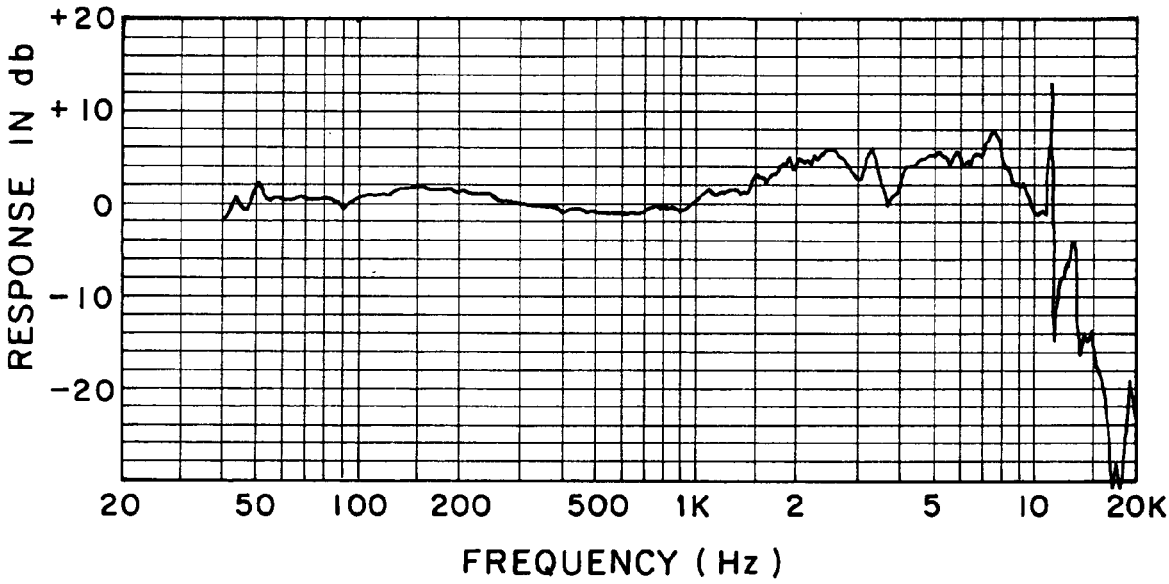
FIG. 2 is a graph to represent a frequency response of a dynamic microphone using the vibrating plate of the invention.

Referring to FIGS. 1*a*, 1*b*, 1*c*, 1*d* and 2, an embodiment will be described. The present invention is not restricted to this embodiment. FIGS. 1*a*, 1*b*, 1*c* and 1*d* are explaining views of manufacturing steps of a vibrating plate of the invention. FIGS. 1*b*, 1*c* and 1*d* are expanded cross sectional views of the left part of FIG. 1*a*. FIG. 2 is a graph to represent a frequency response of a dynamic microphone with the vibrating plate of this invention.

Figure 3:
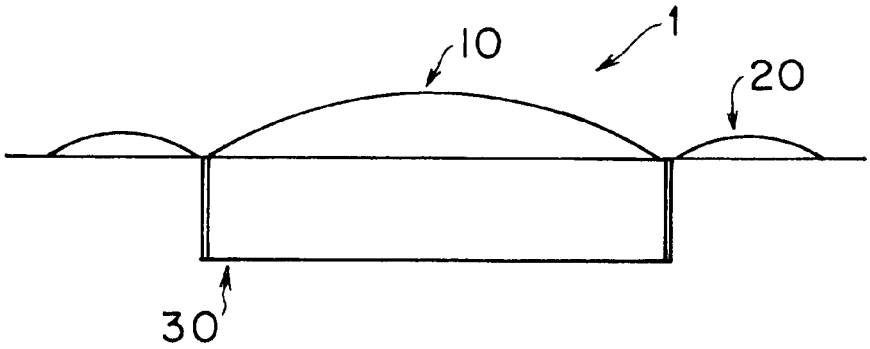
FIG. 3 PRIOR ART
FIG. 3 is a side elevation view illustrating a vibrating plate used in a dynamic microphone of a prior art.

In a manufacturing method of this invention, as shown in FIG. 1*a*, the vibrating plate is set on a rotating pedestal 40 as a first step. As above-described in FIG. 3, the vibrating plate 1 includes a center dome 10 and a sub-dome 20 connecting and communicating with the outer circumference of the center dome 10. Both domes are formed and integrated with synthetic resin such as polyethylene or polyester. In the manufacturing step of this example, a voice coil 30 has not yet mounted on the vibrating plate 1, however, the voice coil can be installed on the vibrating plate in the step before the subject step.

A supporting surface 41 including concave surfaces fitting to convex surfaces of the center dome and the sub-dome is formed on the rotating pedestal 40. The vibrating plate 1 is placed upside down relating to the supporting surface 41, that is, the plate 1 is set with the concave surfaces of the center dome 10 and the sub-dome 20 facing up in FIG. 1*a*.

In this example, the center portion of the rotating pedestal 40 has a suction through-hole 42 communicating to a negative pressure source (not shown) so that the vibrating plate 1 is temporally fixed on the pedestal 40 by a sucking function of negative pressure. However, a clip or the like for pressing the edge of the vibrating plate 1 can be used as another fixing means.

As a second step, an ultraviolet curing-resin without volatile components (organic solvent) 50 which is a peripheral treatment agent is applied to the sub-dome 20 in order to form a damping thin film, as shown in FIG. 1*b*. The ultraviolet curing-resin can be applied from a dispenser-nozzle which is generally used. However, it is preferable that the applied position of the sub-dome is the inner circumference of the sub-dome 20*a* and the ultraviolet curing-resin without volatile components is applied to form a streak-pattern on the whole inner circumference of the sub-dome, for example, the streak-pattern is formed while the rotating pedestal 40 is rotated.

The product No. 5X634A of CHEMITEC INC. (Composition: urethane acrylate polymer of 40 to 50 wt %, acrylate monomer of 40 to 50 wt %, and the rest of adhesive assistant and photo initiator of 3.6 to 5.0 wt %) can be exemplified as the ultraviolet curing-resin without volatile components 50 used in this invention. An amount of the application can be optionally determined due to the thickness of the damping thin film finally obtained and the area of the sub-dome 20.

As a third step after the second one, the step is carried out that the ultraviolet curing-resin 50 spontaneously falls along the curved surface of the sub-dome 20 by gravity without the action of centrifugal force so that the resin conforms to the dome surface of the sub-dome 20, as shown in FIG. 1*c*.

In this case, the rotating pedestal 40 can be slowly rotated without the action of centrifugal force. It is preferable that the ultraviolet curing-resin 50 spontaneously falls by gravity as far as the lowest part of the sub-dome 20.

After the ultraviolet curing-resin 50 has conformed to the sub-dome 20 in the third step, as a fourth step, the rotating pedestal 40 is rotated so that the ultraviolet curing-resin 50 is formed to the thin film by spreading the resin as far as the outer circumference 20*b* of the sub-dome 20.

In this case, the rotation speed of the pedestal 40 depends on viscosity of the ultraviolet curing-resin 50, however, it is preferable that the rotation speed is approximately 10 rpm to 500 rpm. At a rotating speed of less than 10 rpm, the ultraviolet curing-resin 50 may not spread equally to the outer circumference 20*b* of the sub-dome 20 and at a speed of more than 500 rpm the ultraviolet curing-resin 50 may spread beyond the sub-dome 20. Consequently, the speed of less than 10 rpm or more than 500 rpm is not preferable.

After it is confirmed that the ultraviolet curing-resin 50 has been formed to the thin film, as a fifth step, the thin film resin is hardened by emitting ultraviolet rays with an ultraviolet light bulb (not shown) so that the thin film resin becomes the damping thin film 50*a*. It is preferable that the equal hardness of the whole of the damping thin film 50*a* is obtained by emitting ultraviolet rays while the pedestal 40 is rotated. Next, the vibrating plate is removed by releasing the sucking function of negative pressure of the suction through-hole 42.

According to this invention, the damping thin film 50*a* which has stable quality is shortly formed with no influence of the ambient environment. It is preferable that the damping thin film 50*a* has a thickness of 10 μm to 0.5 mm and a hardness of Shore D-scale 15±10 (especially, 15±5) in order to suppress the abnormal resonance in the moderate high frequency range of 2 kHz to 8 kHz of the frequency response.

Figure 4:
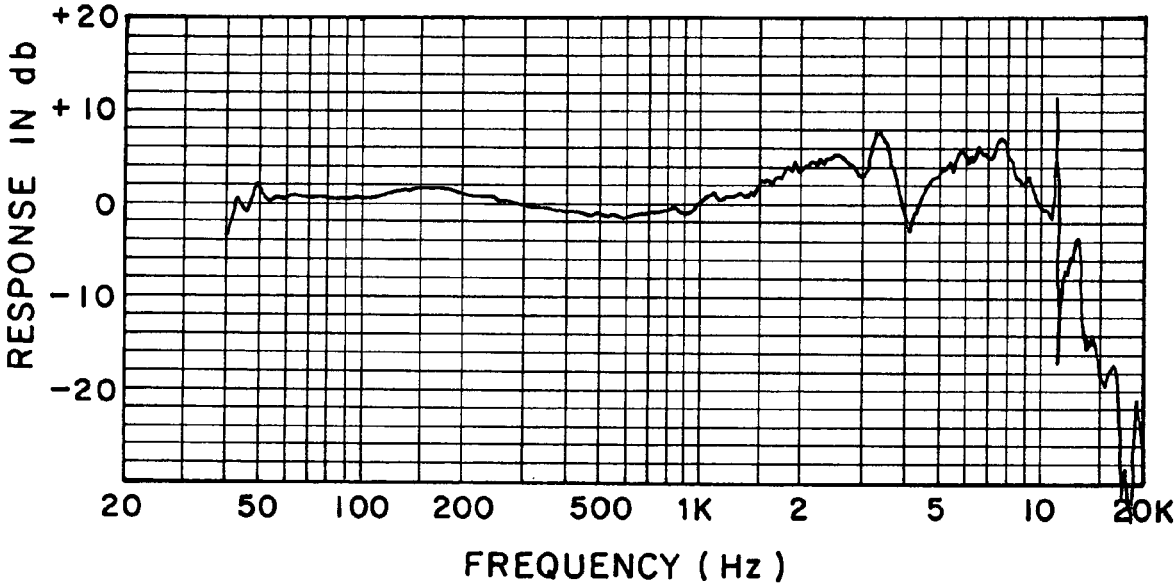
FIG. 4 PRIOR ART
FIG. 4 is a graph to represent a frequency response of the dynamic microphone of the prior art.

FIG. 2 is a graph to represent the frequency response of the dynamic microphone with the vibrating plate of this invention. It can be observed that the abnormal resonance in the moderate high frequency range of 2 kHz to 8 kHz is decreased compared with that of the frequency response in the prior art of FIG. 4.

The invention claimed is:

1. A vibrating plate of a dynamic microphone having a center dome disposing an electricity generating voice coil, the vibrating plate having a subdome connecting and communicating with the outer circumference of the center dome, the vibrating plate comprising:

a damping thin film on the concave surface of the subdome comprises an ultraviolet curing-resin coating uniformly distributed about substantially the whole area of the concave surface of the subdome; and wherein the damping thin film is about 10 μm to about 0.5 mm thick and is integrated with the subdome.

2. A vibrating plate of a dynamic microphone according to claim 1, wherein the damping thin film has a hardness of Shore D-scale 15 ±10.

* * * * *